United States Patent [19]

Dieter

[11] Patent Number: 4,530,533

[45] Date of Patent: Jul. 23, 1985

[54] SUPPORT COLLAR FOR A TRASH BAG

[76] Inventor: Lynn Dieter, 4225 Nottingham Dr., Youngstown, Ohio 44511

[21] Appl. No.: 519,542

[22] Filed: Aug. 2, 1983

[51] Int. Cl.[3] ..... B65B 67/12; B65F 1/06

[52] U.S. Cl. ..... 294/1.1; 248/99

[58] Field of Search ..... 294/1 R, 1 B, 1 BA, 294/1 BB, 55; 15/257.1, 257.4, 257.6; 141/108, 109, 313, 314, 390, 391; 229/37 E, 38, 39 R; 248/95, 99–101, 311.2; 383/6, 12, 13, 15, 17, 20

[56] References Cited

U.S. PATENT DOCUMENTS

| | | | |
|---|---|---|---|
| 2,365,312 | 12/1944 | Trogman | 248/311.2 X |
| 2,430,155 | 11/1947 | Buttery | 248/95 X |
| 3,744,081 | 7/1973 | Miller | 15/257.1 |
| 3,779,496 | 12/1973 | Welles | 248/99 |
| 4,069,917 | 1/1978 | Stollberg et al. | 229/37 E X |
| 4,185,403 | 1/1980 | Hardgrove | 294/55 X |
| 4,222,598 | 9/1980 | Ullger | 294/1 B |
| 4,268,081 | 5/1981 | Hawkinson | 294/55 |

FOREIGN PATENT DOCUMENTS

| | | | |
|---|---|---|---|
| 549853 | 12/1942 | United Kingdom | 141/390 |

*Primary Examiner*—Johnny D. Cherry
*Attorney, Agent, or Firm*—Harpman & Harpman

[57] ABSTRACT

A support collar for a trash bag holds the disposable trash bag in an open condition by supporting the entire open end of the bag. The support collar is assembled from a collapsible flat shape to form a generally rectangular open ended support that is placed within the open end of a trash bag, the support collar having fastening configuration for detachably securing the trash bag thereto.

1 Claim, 4 Drawing Figures

SUPPORT COLLAR FOR A TRASH BAG

BACKGROUND OF THE INVENTION

1. Field of the Invention

This invention relates to support devices for disposable plastic trash bags that keep the bag open while trash or debris are deposited within.

2. Description of the Prior Art

Prior art devices of this type have included a variety of different designs. See for example U.S. Pat. Nos. 3,744,081, 3,779,496 and U.S. Pat. No. 2,365,312.

In U.S. Pat. No. 3,744,081, a leaf collection container support is disclosed that has an adjustable U-shaped metal frame which is positioned within the open end of a trash bag holding the same open.

U.S. Pat. No. 3,779,496 shows a container having a generally U-shape with a plurality of aligned openings therein. The device supports three sides of a container in which it is inserted.

In U.S. Pat. No. 2,365,312 a receptacle support can be seen having a generally box-like configuration with sides, a bottom and closable top. This device supports a bag placed within.

Applicant's device utilizes a generally rectangular shaped support collar with open ends, the device is self-supporting and is secured within the open end of a disposable trash bag. It provides a self-supporting rigid structure so leaves or the like can be easily raked therethrough into the attached bag. The device is open-ended, its stability is assured by its formation incorporating a wide stable base.

SUMMARY OF THE INVENTION

An easily assembled support collar for a trash bag that is positioned within the open end of a horizontally disposed trash bag. The collar is generally rectangular and self-supporting with foldable support flaps that reinforce the structure. The trash bag is secured to the support collar and has a wide stable base facilitating moving debris into the open end of the trash bag.

DESCRIPTION OF THE PREFERRED EMBODIMENT

A foldable support collar for a trash bag comprises a flat rectangular base 10 having oppositely disposed parallel upstanding side walls 11 and 12 extending from edge portions 13 of the base 10. A top support member 14 extends between said side walls 11 and 12 parallel with said base 10.

Figure 1:
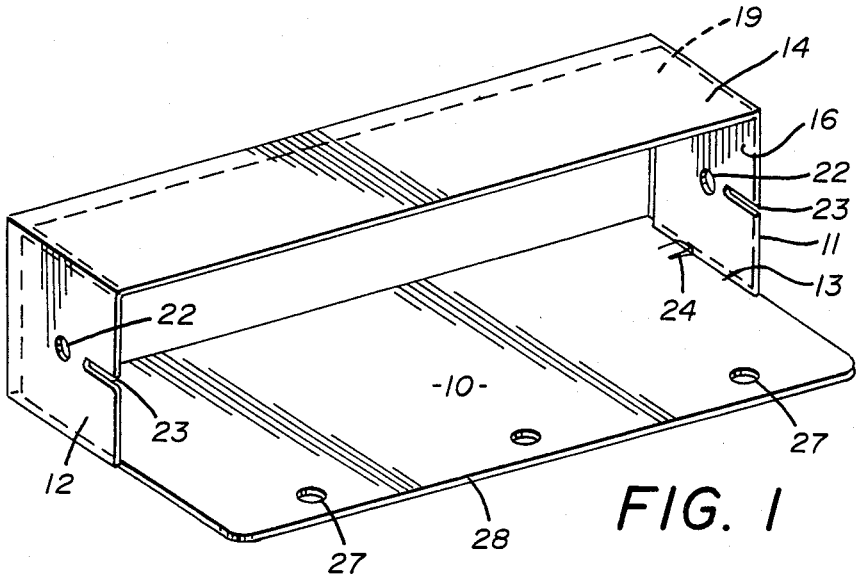
FIG. 1 is a perspective view of the support collar.
Figure 2:
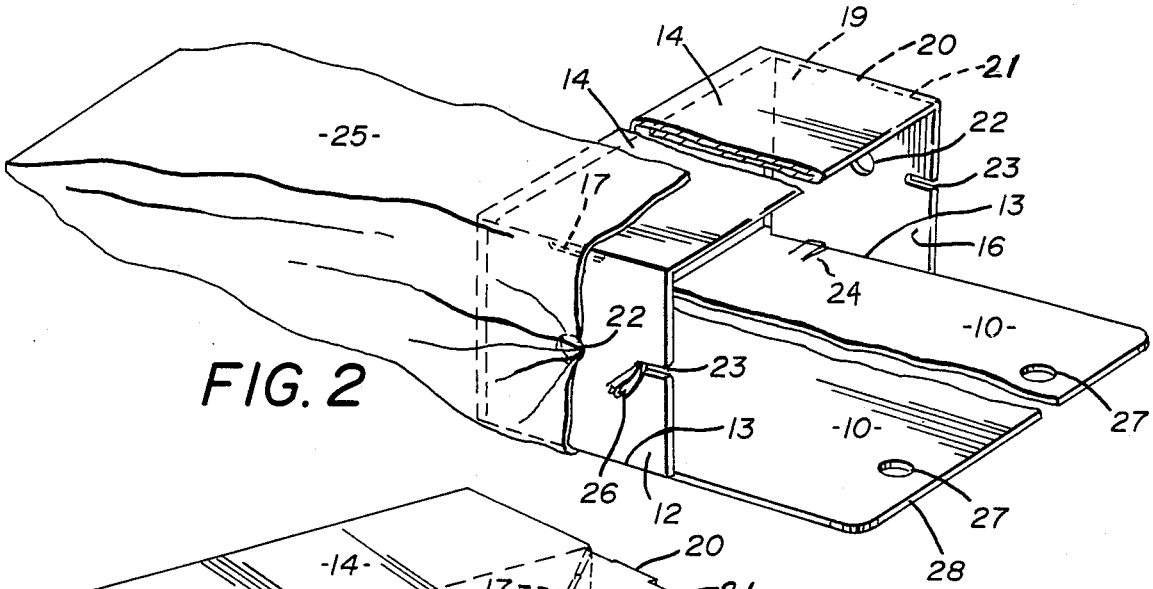
FIG. 2 is a perspective view of the collar with a portion broken away and showing a trash bag secured thereto.
Figure 3:
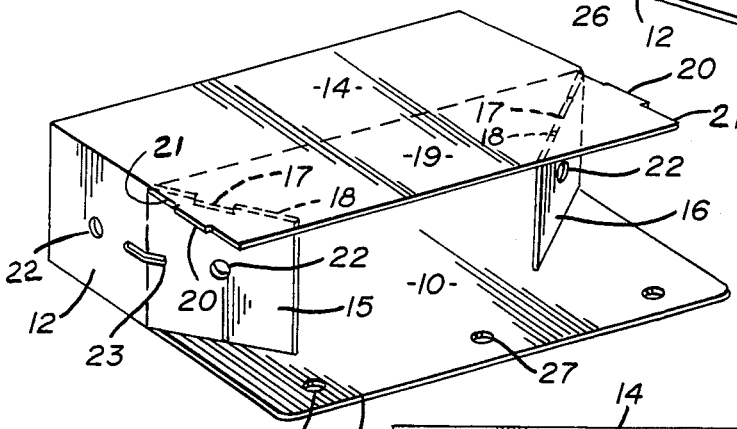
FIG. 3 is a top perspective view of the support collar showing it partially assembled.
Figure 4:
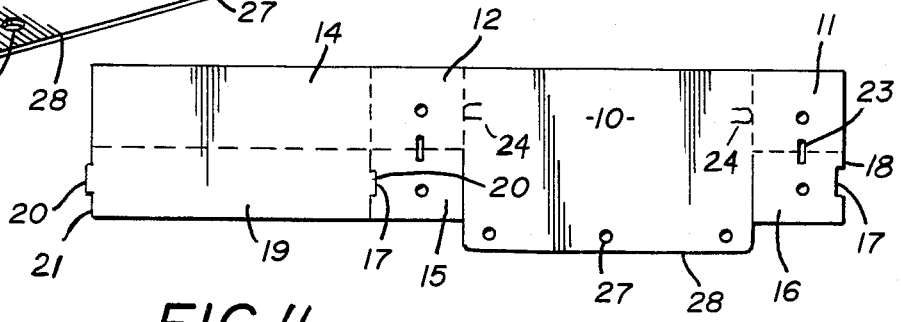
FIG. 4 is a top view of the support collar in blank form before it is assembled.

Referring now to FIG. 4 of the drawings, the support collar will be seen in open position prior to being folded into the working configuration shown in FIGS. 2 and 3 of the drawings.

A pair of secondary reinforced sidewalls 15 and 16 extend from said side walls 11 and 12. Each of the secondary side walls 15 and 16 have a longitudinal notch 17 positioned midway along one edge 18. A secondary top support member 19 extends from said top support member 14 and has oppositely disposed longitudinal tabs 20 extending from each edge 21.

Each of the side walls 11 and 12 and said secondary side walls 15 and 16 have centrally aligned apertures 22 and an elongated slot 23 therebetween. In use, the support collar is unfolded as seen in FIG. 3 of the drawings. The secondary side walls 15 and 16 are folded inwardly against the side walls 11 and 12 aligning the apertures 22 and the portions of the slots 23. The secondary top support member 19 is folded inwardly against the top support member 14 with the longitudinal tabs 20 registering with said longitudinal notches 17 locking the secondary side walls 15 and 16 and top support member 19 in assembled positioned effectively reinforcing the device.

A pair of oppositely disposed locking tabs 24 are formed in the base 10 adjacent its edge portions 13 by cutting a U-shape therein. The locking tabs 24 are pushed inwardly and upwardly, the ends of which engage the secondary side walls 15 and 16 locking the same in position against the side walls 12 and 13.

In operation, the open end of a trash bag 25 is pulled over the support collar with opposite edge portions 26 of the bag gathered together and pulled through the aligned openings 22 in the side walls 11, 12, 15 and 16. The ends 26 of the gathered bag are then wedged into the slots 23 as seen in FIG. 2 of the drawings securing the bag to the device. A plurality of longitudinally aligned apertures 27 are positioned inwardly from an edge 28 of the base 10 and can be used to support the device with the trash bag attached in a horizontal or upright position as so desired.

It will thus be seen that a new and useful support collar for a trash bag has been illustrated and described and it will be apparent to those skilled in the art that various changes and modifications may be made therein without departing from the spirit of the invention and having thus described my invention, what I claim is:

1. A support collar for a trash bag as formed from a foldable cardboard blank consisting of vertically spaced top and bottom rectangular portions, said bottom portion being substantially wider than said top portion, horizontally spaced parallel square side walls joining said top and bottom portions, hinged square extensions of said walls movably positioned in sliding engagement with said top and bottom portions, means for locking said side wall extensions to said top portion, means in said side walls for securing a trash bag thereto, said securing means constituting an opening in said side walls and notches in adjacent edges of said side walls whereby a portion of said trash bag may be pushed through said openings and pulled into said notches in fastening engagement.

* * * * *